US005405198A

United States Patent [19]

Garrett

[11] Patent Number: 5,405,198

[45] Date of Patent: Apr. 11, 1995

[54] PROTECTED SEAL BAG CONSTRUCTION

[75] Inventor: Wayne R. Garrett, Altoona, Iowa

[73] Assignee: Stone Container Corporation, Chicago, Ill.

[21] Appl. No.: 958,649

[22] Filed: Oct. 8, 1992

[51] Int. Cl.[6] ..... B65D 33/10; B65D 33/26

[52] U.S. Cl. ..... 383/61; 383/79; 383/83; 383/113

[58] Field of Search ..... 383/79, 90, 92, 113, 383/114, 88, 89, 83, 61

[56] References Cited

U.S. PATENT DOCUMENTS

| | | | |
|---|---|---|---|
| 2,020,300 | 11/1935 | Cundall | 383/89 |
| 2,378,054 | 6/1945 | Weeks et al. | 383/79 |
| 2,493,349 | 1/1950 | Hoppe | 383/79 |
| 3,100,596 | 8/1963 | Williams et al. | 383/79 |
| 3,141,601 | 7/1964 | Ayres et al. | 383/78 |
| 3,215,335 | 11/1965 | Turpin | 383/83 |
| 3,215,336 | 1/1965 | Turpin | 383/83 |
| 3,266,710 | 8/1966 | Reeves | 383/79 |
| 3,439,468 | 4/1969 | Bok | 383/61 |
| 4,301,925 | 11/1981 | Bogart | 383/61 |

FOREIGN PATENT DOCUMENTS

| | | | |
|---|---|---|---|
| 601874 | 5/1948 | United Kingdom | 383/92 |

OTHER PUBLICATIONS

ISO 6590/1; International Organization for Standardization; circa Jun., 1982; p. 10.

*Primary Examiner*—Stephen P. Garbe
*Attorney, Agent, or Firm*—Dick and Harris

[57] ABSTRACT

A substantially tubular bag for containing materials and protecting same against moisture and fine particle contamination, and having improved resistance to breakdown of structural integrity during loading and handling. At least one outer layer forms an outer tube member, while at least one inner layer forms an inner tube member. The at least one inner layer is formed from a substantially moisture and fine particle-impermeable material. An inner seal closes an end of the inner tube member. Outer closure means are arranged across the end of the outer tube member substantially adjacent to the inner seal. The end of the bag is folded to isolate the inner seal, and the outer closure means is affixed in place against one side of the bag, so as to prevent shock and disruption of the inner seal during loading and/or handling of the bag.

9 Claims, 1 Drawing Sheet

Fig 1
PRIOR ART
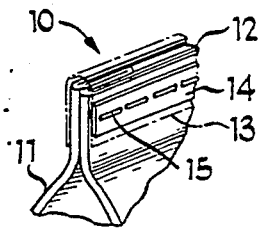
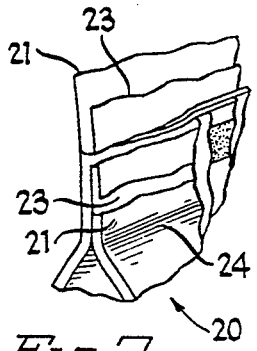
Fig 2
PRIOR ART
Fig 3
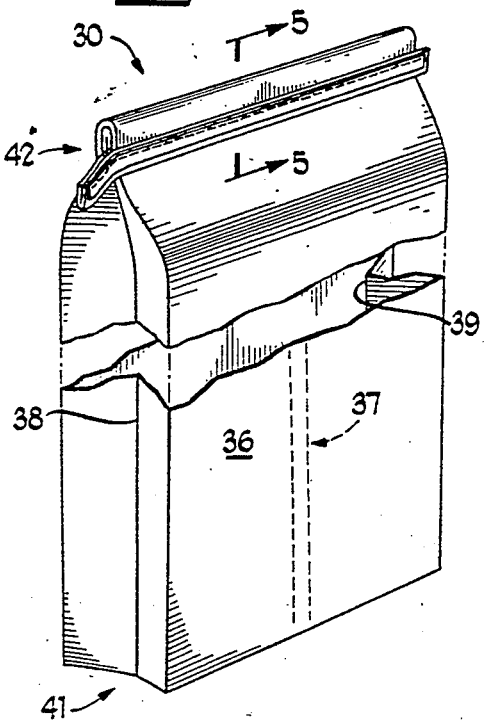
Fig 4
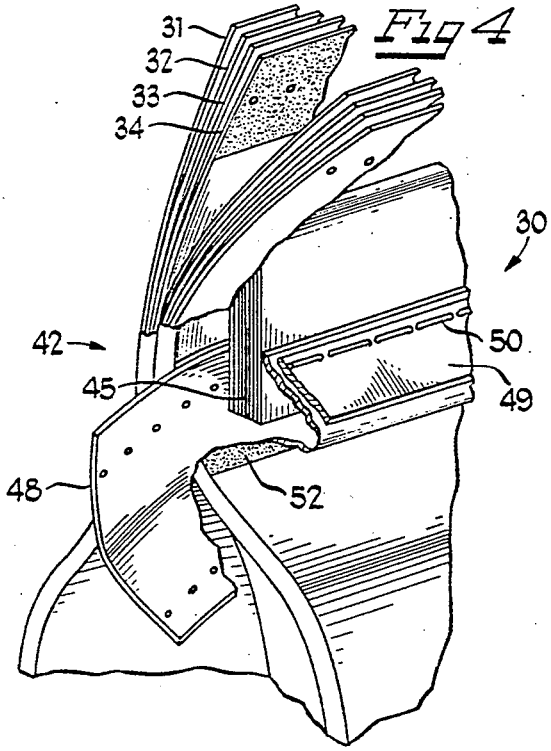
Fig 5
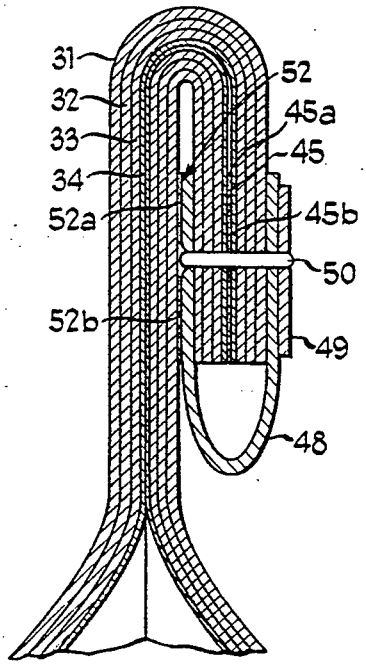

PROTECTED SEAL BAG CONSTRUCTION

BACKGROUND OF THE INVENTION

The present invention is directed to multiple-layer bags which are used to protect materials against contamination from moisture and/or fine particle intrusion.

An example of a multiple-layer bag known in the prior art comprised one or more outer layers, typically fabricated from kraft paper or similar strong but porous paper material. One or more inner layers would also be provided, which would be fabricated from a moisture and fine particle-proof material. The inner and outer layers would be either laid together and rolled into a tube, or separately formed into tubes, with an inner tube then being inserted into the outer tube. In either case, the open ends of the tubes would be flush with one another. In order to prepare the bag for filling, the end of the bag would be flattened. A closure strip would then be folded across the flattened open mouth of the bag, and then sewn shut, often with a "basting" stitch, which would enable rapid opening of the bag by pulling on one particular end of the stitch. A tape or tearstrip might be incorporated into the basting stitch to facilitate removal of the thread. Once the end had been sewn, the sewn end of the bag would be folded over and glued to the side of the bag, with the basting stitch "up", thus producing a bag with one closed end and one open end, ready for shipment to a packager for filling. Once the bag was filled, the packager would then flatten, sew shut, fold and glue the open end of the bag in the same or other conventional manner. While this method produces a relatively strong closure of the bag and is appropriate for materials for which moisture and small particle contamination is not a significant concern, such a closure method does contain the possible drawback that infiltration of moisture and/or migration of fine particles is possible.

Subsequent development in the fabrication of such multiple-layer bags was the introduction of an inner layer fabricated from a moisture and fine particle impervious material, such as polyethylene. Such materials possess the additional characteristic that they can be sealed closed, utilizing heat to form a hermetic seal. The construction of such bags, however, entails more sophisticated and complex manufacturing steps. This prior art bag is formed with the outer layer(s) and the inner layer laid atop one another prior to formation into tubes. The blank formed thereby would then have ends cut in a particular manner so as to produce a stepped configuration of the inner and outer layers on both "sides" of the flat-folded opening. The ends of the bag are then passed through a heat sealing device to close an end of the internal heat-sealable liner. The end of the bag is then folded over and the various exposed sides of the stepped layers affixed to one another with adhesive, thus creating a relatively flat closure of the end of the bag.

The heat-sealed, stepped-end bag, while providing a hermetically sealed inner bag portion, does possess several potential drawbacks. Firstly, opening of the bag is more difficult and more destructive of the overall bag structure, as compared to the sewn-end bag. In addition, the machinery and processes required to create the relatively complex pattern of stepped cuts in the several layers are relatively expensive. In addition, the stepped-end bag construction is capable of providing or producing only a single, given potential bag volume which a packager may use. By contrast, a sewn-end bag enables the customer to selectively shorten the flush cut ends, if he so desires, to package volumes smaller than those which the readymade bag is capable of enclosing.

It is accordingly desirable to provide a bag which is relatively inexpensive to manufacture, and requires relatively less complex machinery and processes to fabricate.

It is a further object of the invention to provide a bag for providing protection against moisture infiltration and fine particle migration, which has an easy-open construction.

It is still another object of the invention to provide a multiple layered bag which permits sizing modifications by a packager prior to filling and final closure, while still providing protection against moisture and fine particle migration.

Yet another object of the invention is to provide such a bag with moisture and fine particle migration protection, which yet permits the opening and reclosure of an inner sealable bag.

Yet a further object of the invention is to provide a bag, for use in protecting and transporting materials and preventing the infiltration of moisture and fine particle migration, which bag is openable and reclosable, and can be used on automated manufacturing machinery.

These and other objects of the invention will become apparent in light of the present Specification, Claims and Drawings.

SUMMARY OF THE INVENTION

The present invention is a substantially tubular bag for containing material and protecting the same against moisture and fine particle migration or contamination. The bag of the present invention has improved resistance to break down of the structural integrity of the seal during loading and handling of the bag, and comprises at least one outer layer which forms an outer tube member having an outer surface, an inner surface, and first and second ends positioned opposite to each other. At least one inner layer forms an inner tube member, operably disposed within the outer tube member and having an outer surface, and oppositely positioned first and second ends. The at least one inner layer is formed from a substantially moisture and fine particle impermeable material.

The outer surface of the inner tube member, and the inner surface of the outer tube member, are juxtaposed in substantially adjacent relation to one another and are operably configured so as to extend substantially coextensively along the common longitudinal axis. The first ends of the inner and outer tube members and the second ends of the inner and outer tube members are operably positioned in respective substantial registry with one another, so as to provide a first common bag end and a second common bag end, respectively, with the first and second common bag ends arranged substantially opposite one another. Inner seal means are operably arranged across the first end of the inner tube member corresponding to the at least one common bag end, to seal closed the inner tube member end to preclude escape of the material and preclude intrusion by moisture or fine particle migration and contamination. The inner seal means operably extend transversely to the inner tube at a selected distance from the inner tube member end. Outer closure means are arranged across the first end of the outer member corresponding to the first common bag end. Fold means are longitudinally spaced from the at least one common (first) bag end at a distance substantially greater than the spacing of the inner seal means from the tube end so as to position the first common bag end in a folded over configuration substantially adjacent a portion of the outer surface of the outer tube member. The at least one common bag end is further affixed to a portion of the outer surface of the outer tube member with the inner seal means operably positioned substantially between the at least one common bag end and the fold means to substantially protect the inner seal means against damage resulting from loading and handling stresses.

In the preferred embodiment of the invention, the outer closure means operably engage the inner seal means to removably attach and close the outer tube member end to the inner tube member end. In this embodiment further, the opposite common bag end is to be sealed after filling of the bag with the contents or material. The (second) opposite end of the bag is sealed in an equivalent fashion to the manner in which the first end has been sealed, though without any kind of tearstrip element needing to be required, or may be sealed by other conventional sealing techniques.

In the preferred embodiment of the invention, the inner tube member is fabricated from heat-sealable thermoplastic material and the inner seal means is a heat seal formed across the first end of said inner tube member.

The outer closure means is formed by a closure tape member operably positioned across the first end of said outer tube member so as to substantially cover and close the outer tube member end. A tear strip member is operably positioned along a side of the closure tape member and stitching operably interconnects the outer tube member end, the closure tape member and the tear strip member. The stitching is preferably a "basting" stitch for enabling rapid unthreading and removal of the stitching, to enable opening of the outer closure means and permit access to the inner tube member, without tearing of the outer tube member.

In the preferred embodiment of the invention the outer tube member comprises a plurality of outer tube layers operably affixed to one another at least at a position substantially adjacent to but longitudinally spaced from the common bag end opposite the at least one common bag end. In this embodiment, the inner tube member and the outer tube member may be operably affixed to one another at least at a position substantially adjacent to and longitudinally spaced from the common bag end opposite the first common bag end for substantially half the length of the bag. The means for sealing both tube members to each other may alternatively be operably disposed at both common bag ends.

The present invention also comprises a method for manufacturing a tubular bag for materials. The steps include providing at least one outer tube layer and forming the at least one outer tube layer onto an outer tube member having an outer surface, an inner surface, and two opposed open ends. At least one inner tube layer is provided which is then formed into an inner tube member having an outer surface, an inner surface, and two opposed open ends. The inner tube member is operably positioned within the outer tube member such that the inner surface of the outer tube member and the outer surface of the inner tube member are operably juxtaposed in substantially adjacent relation to one another. At least one end of the inner tube member is sealed, with the seal extending transversely to the inner tube at a selected distance from the first end. At least one end of the outer tube member is closed corresponding to the sealed end of the inner tube member. Simultaneously, the seal of the inner tube member is engaged to removably attach and close the at least one end of the outer tube member about the at least one end of the inner tube member. The at least one common bag end folded at a distance from the common bag end substantially greater than the distance the seal means is spaced from the tube end, so as to position the at least one common bag end in a folded-over configuration substantially adjacent a portion of the outer surface of the outer tube member. The at least one common bag end is then affixed to the portion of the outer surface of the outer tube member, positioning the inner seal means substantially between the at least one common bag end and the fold to substantially protect the inner seal means against damage resulting from loading and handling stresses to provided a substantially tubular bag. In this embodiment, a quick-release tear strip member may be interposed between the folded-over bag end and the outer surface of the outer tube member to facilitate the separation of the two towards opening a filled bag.

The invention also comprises the method of further filling a bag having one sealed and closed end and remaining open and unsealed common bag end, and thereafter closing the remaining open bag end utilizing the steps described hereinabove.

BRIEF DESCRIPTION OF THE DRAWINGS

FIG. 1 is a fragmentary perspective view of a prior art sewn-end bag.

FIG. 2 is a fragmentary perspective view of a prior art heat sealed bag.

FIG. 3 is a perspective view of the folded, sewn-end bag according to the present invention.

FIG. 4 is an enlarged perspective view of an end of the bag according to FIG. 3.

FIG. 5 is a fragmentary side elevation, in section, of the bag end of the present invention taken along lines 5—5 of FIG. 3 and looking in the direction of the arrows.

DETAILED DESCRIPTION OF THE DRAWINGS

While this invention is susceptible of embodiment in many different forms, there is shown in the drawings and will be described in detail herein, a specific embodiment of the invention, with the understanding that the present disclosure is intented to be an exemplification of the principles of the invention and is not intended to limit the invention to the embodiment illustrated.

Prior art tubular bag construction 10, a conventional sewn end bag is shown in FIG. 1. Prior art bag 10 includes outer layer 11, and inner layer 12, which are formed into tubes with flush cut ends. The closure of such a prior art bag 10 is accomplished by flattening the end to be closed. Afterward, a closure tape 13 (shown in phantom) is folded over the flattened end to extend down both sides of the outer layer. Tear strip 14 is then laid across one side of closure tape 13 and stitching 15 applied. Typically, stitching 15 is a kind of removable basting stitch, which may be simply pulled at an end and removed, without tearing of the tape, tear strip or bag material. The closure provided by such a prior art bag tent is effective in preventing escape of large sized particle material within the bag, as well as preventing the intrusion of a similar large-sized particle material from outside. However, such a closure is not a hermetic seal, the bag material itself was usually not moisture or particle proof, and the possibility existed for intrusion by moisture and/or fine particle migration or contamination. Typically, such an end closure is not folded over or otherwise secured, other than by the stitching.

Prior art bag 20, shown in FIG. 2, is a stepped end bag. Prior art bag 20 is formed form outer layer(s) 21 and inner layer 23. Inner layer 23 may be thermoplastic material, which is both waterproof and sift proof (resistant to fine particle infiltration). In addition, inner layer 23 might be heat sealable, so as to permit closure by passing a flattened end of the bag past a combination of heat supplying rollers or the like to create a sealed closure. The outer layers 21 of prior art bag 20 are not flush cut as in the case of the sewn end bag of FIG. 1 previously discussed. Instead, the various layers are cut in a stepped fashion, relative to the longitudinal axis of the bag, so as to expose selected areas of the several layers. An adhesive material will then be disposed upon these various exposed areas. Once the heat seal has been applied to the inner layer, the outer layers will be folded over, so that the different step portions on either side of the opening mouth will come into registry, and then further folded, for example at 24, and the folded end glued to the outside of the bag, to create a strong and relatively flat and smooth sealed closure. The construction of prior art bag 20 provides a hermetically sealed enclosure. However, opening of the bag requires either cutting of the outer layer in order to get to the inner layer, or the inclusion of some form of embedded tear strip,, typically within the overlapping layers which adhere together to form the outer closure. In either event, a certain degree of tearing and destruction of the outer layers is necessary for opening, which may make re-use of the outer bag, if desired, difficult or impossible.

The improved sewn end bag 30 of the present invention is shown in FIGS. 3–5. Improved bag 30 is formed from outer layers 31, 32 and 33. Inner layer 34 is a heat sealable, moisture and fine particle-proof thermoplastic material or of a similar material suitable for a hermetic seal. Outer layers 31–33 and inner layer 34 are initially formed as flat web-fed blanks. For purposes to be described hereinafter, outer layers 31–33 and inner layer 34 are all affixed to one another at one end, either prior to or after formation, through conventional means, into a cylindrical tube 36. In addition, inner layer 34 may be affixed to innermost outer layer 33 by a fine line of adhesive, such as longitudinally deposited adhesive 37. In a preferred embodiment of the invention, adhesive 37 extends substantially only half way along the length of bag 30, from approximately midway along the length of bag 30 toward the still-open (customer) end 41. In this manner, it is possible to open the bag at end 42, open the sealed end of inner layer 34, for the further addition or removal of material, and subsequent re-sealing and reclosure of the bag. Gussets 38 and 39 may be formed into the sides of tube 36 to facilitate compact flat folding and stacking of tubes 36, between manufacturing steps, as well as to facilitate an expansive fillable bag structure from an otherwise flat rectangular configuration.

Outer layers 31—33 and inner layer 34 are either initially formed, or are trimmed so as to have flush even ends at both ends 41 and 42.

Since it is typically the case that the manufacturer of such bags is not the packager who will fill and ultimately close the bags, it is desirable to fabricate the bags in appropriate condition for facilitated filling and subsequent closure by the packager. It has been previously described that the outer and inner layers may be affixed to one another at one end of the bag. This end of the bag will be left open to be the filling end by the packager. The affixation positioned at the opening, which can extend for ½ the length of the bag (see adhesive bond 37 in FIG. 3) facilitates ready opening of that end by the packager and prevents the inadvertent deposit of the material to be packaged in between the inner and outer layers, rather than fully within the interior of the bag. Accordingly, the non-attached end 42 will be the end sealed and closed by the initial bag manufacturer.

Bag end 42 is then passed through a combination heater and roller set to create a transverse heat seal zone 45 which has a width extending from seal points **45*a* to 45*b*, along the direction of the longitudinal axis of the bag 30; typically on the order of one-half inch. The seal in such plastic materials can also be created through the use of an ultrasonic vibration emitter and anvil combination. In a still further alternative embodiment, the seal at the end of inner layer 34 may be obtained through the use of conventional adhesive material disposed along the inner edge of inner layer 34. Bag 30 now having heat sealed inner layer 34, is then passed through a conventional taping and stitching apparatus, which applies a closure tape 48, tear strip 49, and stitching 50, which, in the preferred embodiment, comprises a basting stitch such as previously described. End 42 of bag 30 is then folded at a location between heat seal 45 and the remaining, open second end 41 of bag 30. The stitched end is then glued to the outside of bag 30, with stitching 50 exposed to the outside. The adhesive 52 used to hold down end 42 (see FIG. 5) may be of a type known as fugitive glue, so as to enable the prying up of end 42 with sufficient pressure. Alternatively, the adhesive may be of a more permanent kind, such that upon the removal of stitching 50, closure tape 48 remains affixed to the outside layer of bag 30, while freeing end 41 to be opened. Regardless of which type of adhesive is used, adhesive 52 is preferably deposited in strips 52*a* and 52*b*, to eliminate adhesive contact with stitching 50, to, in turn, facilitate removal of stitching 50** upon opening.

Bag 30 is now in condition for being transmitted to the packager, who will open the remaining open second end of the bag and fill it with the charge of packaging material, closing and sealing the same manner as previously described, or through conventional sealing techniques.

Through the advantageous positioning of the heat seal around the fold in the closed end of the bag, and the subsequent affixation by adhesive of the folded end to the outside of the bag, the bag is provided with an improved capacity for withstanding the shock of loading, so as to protect the integrity of the interior heat seal. In addition, the durability of the heat seal during handling of the filled and sealed package is likewise enhanced.

A further advantage of the described construction is the adaptability of the bag to different packager's requirements. The stepped end bag previously described, once fabricated, has a fixed volume. Accordingly, a particular packager would have to purchase bags of different sizes in order to accommodate the preparation of packages of different volumes. In addition, adjustment of the machinery for filling and sealing the different sized packages would be required. The present construction, however, enables a manufacturer to appropriately "shorten" bag 30, without reconstruction of any stepped bag configuration so as to meet the manufacturer's requirements for a lesser volume bag, if so desired.

A further advantage of the improved bag 30 is its capacity to be opened and re-filled and re-sealed, with only a slight loss in volume between successive openings and reclosures. For example, in the packaging of food products, a first packager may load and seal a bag with a partial charge of food products. The bag may then be transported to a subsequent packager, who will open the outer bag in a non-destructive manner using the removable stitching, and open the heat seal. After placing an additional charge of material within the bag, the bag can then be resealed through reheating of the thermoplastic material.

The foregoing description and drawings merely explain and illustrate the invention and the invention is not limited thereto except insofar as the appended claims are so limited, as those skilled in the art who have the disclosure before them, will be able to make modifications and variations therein without departing from the scope of the invention.

What is claimed is:

1. A substantially tubular bag for containing material and protecting same against moisture and fine particle migration or contamination, and having improved resistance to breakdown of structural integrity during loading and handling, said substantially tubular bag comprising:

at least one outer layer operably configured to form an outer tube member having an outer surface, an inner surface, a first end at which said bag is to be opened for access to said material and a second end opposite to said first end;

at least one inner layer operably configured to form an inner tube member having an interior region, said inner tube member operably disposed within said outer tube member and having an outer surface, an inner surface and a first end and a second end positioned opposite to said first end, said at least one inner layer being formed from a substantially moisture and fine particle impermeable material, said outer surface of said inner tube member and said inner surface of said outer tube member being juxtaposed in substantially adjacent relation to one another, and operably configured so as to extend substantially coextensively along a common longitudinal axis, with said first ends of said inner and outer tube members and said second ends of said inner and outer tube members operably positioned in respective substantial registry with one another, so as to provide a first common bag end and a second common bag end, respectively, said first and second common bag ends arranged substantially opposite one another;

means operably arranged across said inner surface of the first end of said inner tube member corresponding to said at least one common bag end, for sealing closed said interior region of said inner tube member end to preclude escape of said material and preclude intrusion by moisture or fine particle migration and contamination, said inner sealing means extending transversely to the longitudinal axis of said inner tube member at a selected distance from said inner tube member end;

means, operably arranged across said first end of said outer tube member corresponding to said at least one common bag end, for closing said at least one end of said outer tube member, means operably longitudinally spaced from said at least one common bag end of said first end, for enabling positioning of said at least one common bag end in a folded-over configuration substantially adjacent a portion of said outer surface of said outer tube member, said at least one common bag end being further affixed to said portion of said outer surface of said outer tube member, with said inner sealing means operably positioned substantially between said at least one common bag end and said folding means to substantially preclude material with which said bag may be filled from spreading apart opposed sides of the inner layer, and contacting and exerting force directly upon said inner sealing means so as to protect said inner sealing means against damage resulting from loading and handling stresses.

2. The invention according to claim 1 in which said outer closing means includes means for removably attaching and closing said outer tube member end to said inner tube member end.

3. The invention according to claim 1 in which the second ends of said at least one outer and inner layers are sealed to enclose said material within said substantially tubular bag.

4. The tubular bag for containing material according to claim 1 wherein at least said inner tube member is fabricated from heat sealable thermoplastic material and said inner sealing means comprises a heat seal formed across said first end of said inner tube member.

5. The tubular bag for containing material according to claim 2 wherein said means for removably attaching and closing said outer tube member to inner tube member end comprises:

a closure tape member operably positioned across said first end of said outer tube member so as to substantially cover and close said outer tube member end;

a tear strip member operably positioned along a side of said closure tape member; and means for operably interconnecting said first end of said outer tube member said closure tape member and said tear strip member.

6. The tubular bag for containing material according to claim 5 wherein said stitching means comprises a basting stitch for enabling rapid unthreading and removal of same to enable opening of said outer closing means and permit access to said inner tube member, without tearing of said outer tube member.

7. The tubular bag for containing material according to claim 1 wherein said inner tube member and said outer tube member are operably affixed to one another, at least at a position substantially adjacent to, but longitudinally spaced from, the second common bag end opposite said first common bag end.

8. The tubular bag for containing material according to claim 1 wherein said inner sealing means are operably disposed at both said first and second common bag ends.

9. The tubular bag for containing material according to claim 1 wherein said at least one inner layer is operably affixed to said at least one outer layer by adhesive material operably disposed therebetween along a region extending parallel to said common longitudinal axis for at least substantially one-half the length of said inner and outer tube members, from a position substantially adjacent said second common bag end.

* * * * *